US008719986B2

(12) United States Patent
Kim et al.

(10) Patent No.: US 8,719,986 B2
(45) Date of Patent: May 13, 2014

(54) CONTROL METHOD OF WASHING MACHINE

(75) Inventors: Pyounghwan Kim, Changwon-si (KR); Hyungyong Kim, Changwon-si (KR); Seogkyu Park, Changwon-si (KR); Youngkee Oh, Changwon-si (KR); Deughee Lee, Changwon-si (KR); Eunjin Park, Changwon-si (KR); Taehyok Kwon, Changwon-si (KR)

(73) Assignee: LG Electronics Inc., Seoul (KR)

( * ) Notice: Subject to any disclaimer, the term of this patent is extended or adjusted under 35 U.S.C. 154(b) by 208 days.

(21) Appl. No.: 13/232,480

(22) Filed: Sep. 14, 2011

(65) Prior Publication Data

US 2012/0060301 A1 Mar. 15, 2012

(30) Foreign Application Priority Data

Sep. 15, 2010 (KR) ..... 10-2010-0090798
Sep. 15, 2010 (KR) ..... 10-2010-0090799

(51) Int. Cl.
*D06F 33/02* (2006.01)

(52) U.S. Cl.
USPC ..... 8/158; 8/159; 8/137; 134/10; 210/167.01; 68/12.01

(58) Field of Classification Search
CPC ..... D06F 33/02; D06F 35/005; D06F 33/007; Y02B 40/56; A47L 15/0031
USPC ..... 8/157; 134/34
See application file for complete search history.

(56) References Cited

U.S. PATENT DOCUMENTS

2005/0217036 A1* 10/2005 Park ..... 8/158
2011/0192655 A1* 8/2011 Kim et al. ..... 177/1
2012/0011659 A1* 1/2012 Park ..... 8/137

FOREIGN PATENT DOCUMENTS

JP 09-028974 A 2/1997
JP 2004-121883 A 4/2004

* cited by examiner

*Primary Examiner* — Michael Barr
*Assistant Examiner* — Thomas Bucci
(74) *Attorney, Agent, or Firm* — Birch, Stewart, Kolasch & Birch, LLP

(57) ABSTRACT

Disclosed herein is a control method of a washing machine which minimizes damage to laundry to be washed. The control method includes executing a washing cycle to wash laundry to be washed by supplying wash water, dissolving detergent in wash water and washing the laundry, executing a rinsing cycle to rinse the laundry by draining wash water, spin-drying the laundry, and rinsing the laundry, and executing a spin-drying cycle to spin-dry the laundry by draining wash water and spin-drying the laundry, wherein the dissolving of the detergent is carried out at a water level lower than a predetermined reference water level.

13 Claims, 14 Drawing Sheets

CONTROL METHOD OF WASHING MACHINE

This application claims the benefit of Korean Patent Application No. 10-2010-0090798, 10-2010-0090799 filed on Sep. 15, 2010, which are hereby incorporated in its entirety by reference as if fully set forth herein.

BACKGROUND OF THE INVENTION

1. Field of the Invention

The present invention relates to a control method of a washing machine, and more particularly, to a control method of a washing machine which minimizes damage to laundry to be washed.

2. Discussion of the Related Art

In general, washing machines are divided into a top loading type and a front loading type according to laundry input methods. Furthermore, top loading type washing machines are divided into a type in which a drum is rotated in washing and rinsing processes, a type in which a pulsator is rotated, and a type in which a drum and a pulsator are respectively rotated.

From among the top loading type and the front loading type washing machines, a drum rotating type washing machine causes small abrasion of laundry and requires a small amount of wash water used, as compared to a pulsator rotating type washing machine, but tends to have low washing performance.

From among the top loading type washing machines, a pulsator rotating type washing machine has excellent washing performance but tends to cause large abrasion of laundry and require a large amount of wash water used, as compared to a drum rotating type washing machine.

In order to compensate for these disadvantages, a top loading type washing machine including both a drum and a pulsator has been developed.

When such a washing machine is controlled so as to increase washing performance, an amount of lint generated due to abrasion of laundry to be washed increases, and when the washing machine is controlled so as to reduce abrasion of the laundry to be washed, washing performance is lowered.

Therefore, a method of minimizing damage to laundry to be washed while maintaining washing performance is required.

SUMMARY OF THE INVENTION

Accordingly, the present invention is directed to a control method of a washing machine.

An object of the present invention is to provide a control method of a washing machine which minimizes damage to laundry to be washed while maintaining washing performance.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a control method of a washing machine includes executing a washing cycle to wash laundry to be washed by supplying wash water, dissolving detergent in wash water and washing the laundry, executing a rinsing cycle to rinse the laundry by draining wash water, spin-drying the laundry, and rinsing the laundry, and executing a spin-drying cycle to spin-dry the laundry by draining wash water and spin-drying the laundry, wherein the dissolving of the detergent is carried out at a water level lower than a predetermined reference water level.

In the washing of the laundry, a centrifugal tumbling operation of rotating a drum at a high velocity in one direction to cause wash water to flow over the drum and then to drop onto the laundry, a tub/drum rotating operation of rotating the drum in both directions, and a pulsator rotating operation of rotating a pulsator in both directions may be executed together.

In the washing of the laundry, the centrifugal tumbling operation, the tub/drum rotating operation and the pulsator rotating operation may be executed at least once for a predetermined washing time.

The centrifugal tumbling operation and the tub/drum rotating operation may be executed at the predetermined reference water level, and the pulsator rotating operation may be executed at a water level higher than the reference water level.

In the washing of the laundry, a tub/drum rotating operation to disperse the laundry may be further executed after the pulsator rotating operation.

The rinsing of the laundry may be executed plural times automatically according to an amount of the laundry or by selection of a user, and, in the rinsing of the laundry prior to the final rinsing of the laundry, wash water may be additionally supplied to a water level higher than the predetermined reference water level.

In the rinsing of the laundry prior to the final rinsing of the laundry, the drum may be rotated after the additional supply of wash water.

In the rinsing of the laundry prior to the final rinsing of the laundry, wash water in the drum may be partially drained after the rotation of the drum such that wash water is lowered to the reference water level from the water level higher than the reference water level.

In the rinsing of the laundry prior to the final rinsing of the laundry, the additional supply of wash water, the rotation of the drum and the partial drainage may be repeated plural times.

In the rinsing of the laundry prior to the final rinsing of the laundry, a drain valve may be closed during the rotation of the drum.

The partial drainage may be executed in a stopped state of the drum.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, a control method of a pulsator type washing machine in accordance with one embodiment of the present invention in which both a pulsator and a drum are rotatable will be exemplarily described in detail with reference to the accompanying drawings.

First, the configuration of the washing machine in accordance with the embodiment of the present invention will be described in brief, as follows.

Figure 1:
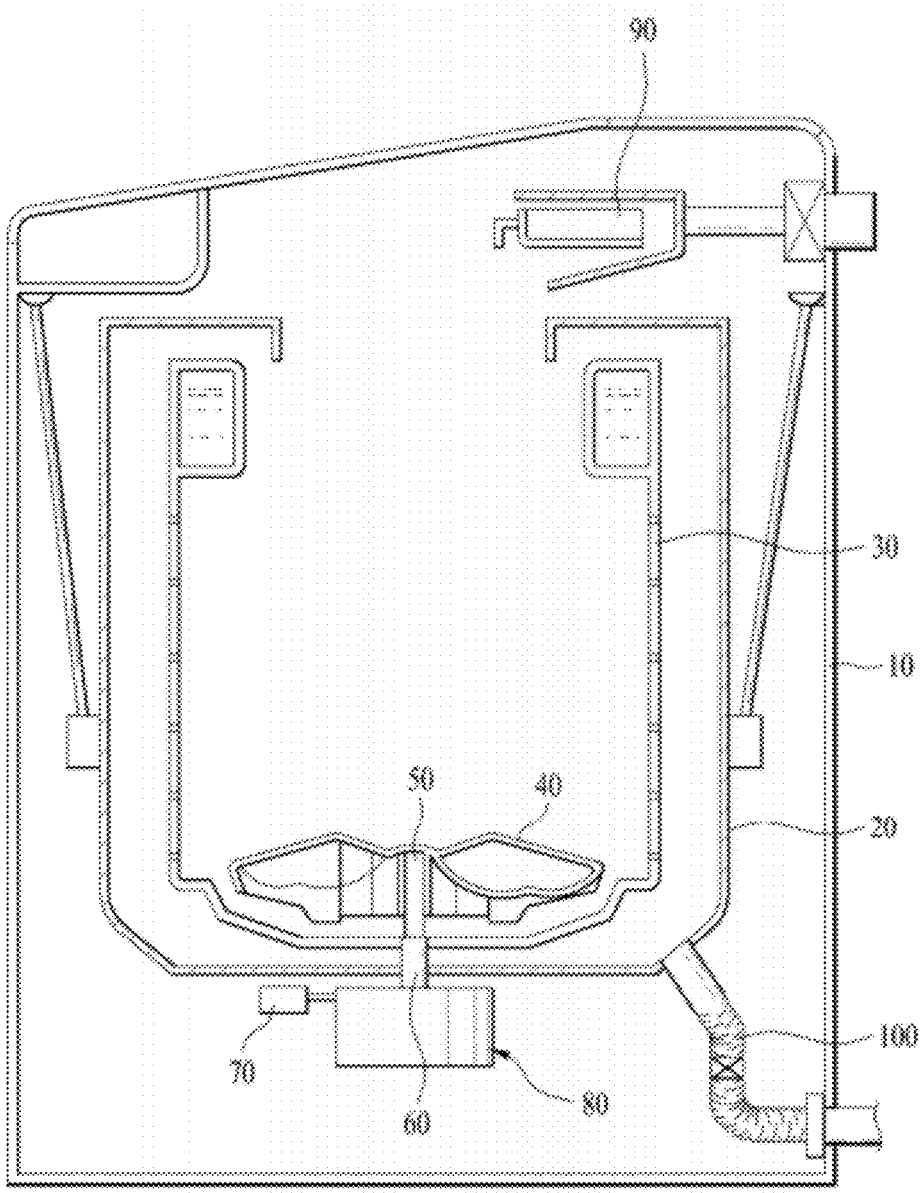
FIG. 1 is a cross-sectional view of a washing machine in accordance with one embodiment of the present invention.

As shown in FIG. 1, the washing machine in accordance with the embodiment of the present invention includes a cabinet 10 forming the external appearance of the washing machine, a tub 20 installed within the cabinet 10, and a drum 30 rotatably installed within the tub 20 and used for washing or rinsing of laundry.

A pulsator 40 rotatable together with or separately from the drum 30 is installed within the drum 30. The pulsator 40 is connected to a washing shaft 50, and a spin-drying shaft 60 is coupled with the washing shaft 50. The washing shaft 50 and the spin-drying shaft 60 are connected to a motor 80, and the washing shaft 50 and the spin-drying shaft 60 are rotatable by rotation of the motor 80. A clutch 70 causes the washing shaft 50 and the spin-drying shaft 60 to be respectively or simultaneously rotated. That is, the clutch 70 may rotate the washing shaft 50 to rotate the pulsator 40, or rotate the spin-drying shaft 60 to rotate the drum 30.

A water supply unit 90 connected to an external water supply source to supply water is provided above the drum 30, and a drain pipe 100 to drain wash water is provided at one side of the lower portion of the tub 20 and connected to the outside of the cabinet 10.

The washing machine in accordance with this embodiment of the present invention is controlled such that the drum 30 or the pulsator 40 are rotated during washing or rinsing of laundry to be washed and the drum 30 is rotated during spin-drying of the laundry.

Figure 2:
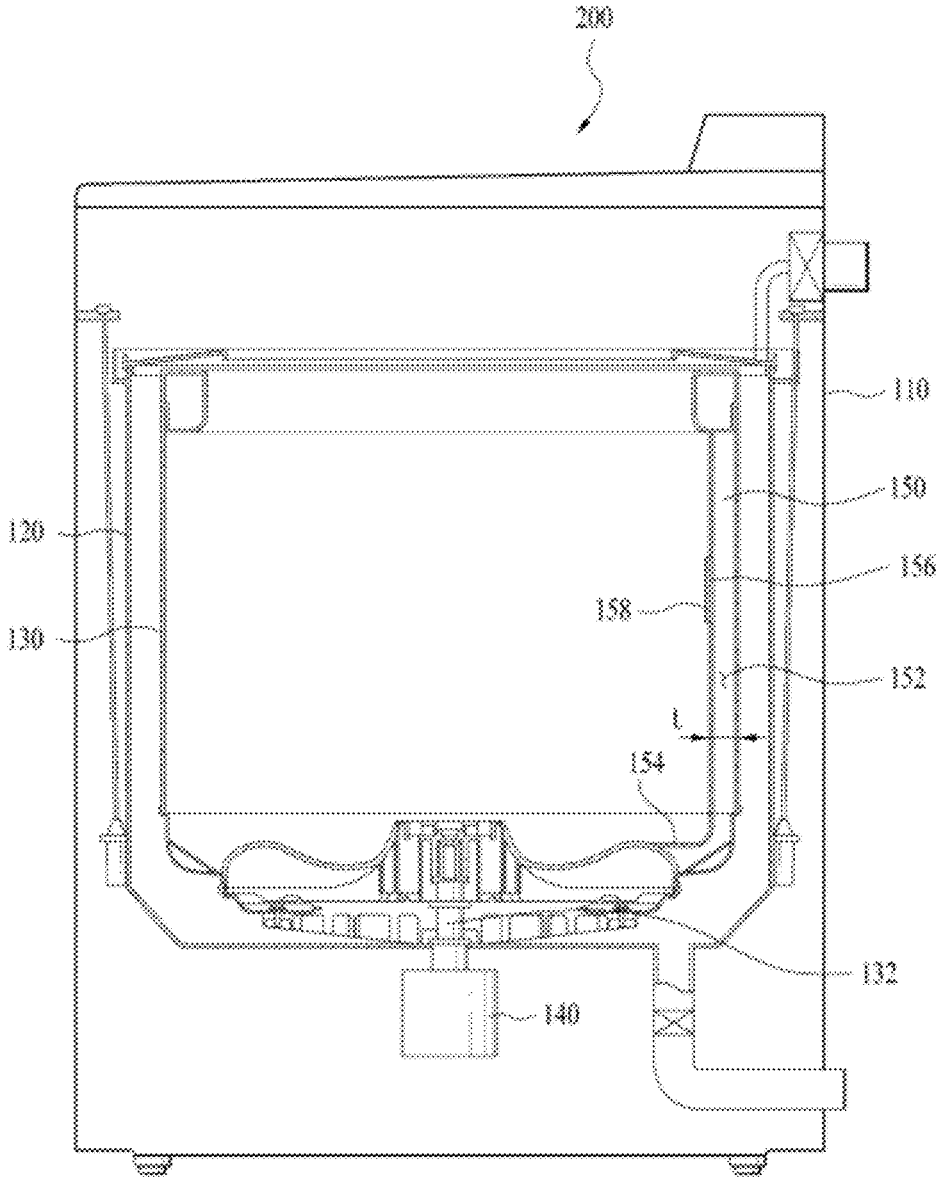
FIG. 2 is a cross-sectional view of a washing machine in accordance with another embodiment of the present invention.

FIG. 2 is a cross-sectional view of a washing machine having a filter assembly in accordance with another embodiment of the present invention.

With reference to FIG. 2, a washing machine 200 in accordance with this embodiment includes a tub 120 provided within a cabinet 110, and a drum 130 rotatably provided within the tub 120. The drum 130 may be rotated around a vertical shaft 132. The drum 130 may be rotated by a motor 140 provided on the lower portion of the tub 120. Further, a filter assembly 150 may be provided on the side wall of the drum 130. In more detail, the filter assembly 150 may be provided along the side wall of the drum 130 and include a circulation channel 152, formed therein, along which wash water is circulated. The filter assembly 150 may further include an inflow hole 154, formed at the lower portion thereof, through which wash water is introduced into the filter assembly 150, and a discharge hole 156, formed at the central portion thereof, through which wash water is discharged, and a filter unit 158 to filter wash water may be provided at the discharge hole 156. Therefore, wash water introduced into the filter assembly 150 from the lower portion of the drum 130 is raised along the circulation channel 152 according to rotation of the drum 130 and is resupplied to the inside of the drum 130 via the filter unit 158.

In the above-described washing machine 200, the tub 120 is provided at the outside of the drum 130, and thus the filter assembly 150 may protrude toward the inside of the drum 130. That is, as shown in FIG. 2, the filter assembly 150 may protrude toward the inside of the drum 130 by a designated thickness t. If the filter assembly 150 protrudes toward the inside of the drum 130 in this fashion, friction and collision between laundry and the filter assembly 150 frequently occurs when the drum 130 is rotated, and causes abrasion of the laundry and generates a large amount of foreign substances, such as lint, thereby generating damage to the laundry.

A washing machine in accordance with a further embodiment which will be described later includes a drum rotated around a vertical shaft and does not have a filter unit to filter water in the drum. Therefore, generation of foreign substances, such as lint, due to abrasion of the laundry and damage to the laundry caused by protruding of the filter unit along the side wall of the drum may be prevented. However, the washing machine does not have the filter unit and may thus require a configuration to discharge foreign substances, such as lint, generated from laundry during the washing or rinsing cycle. Hereinafter, a structure of a drum which removes foreign substances from the inside of the drum without any filter unit, and a control method thereof will be described.

Figure 3:
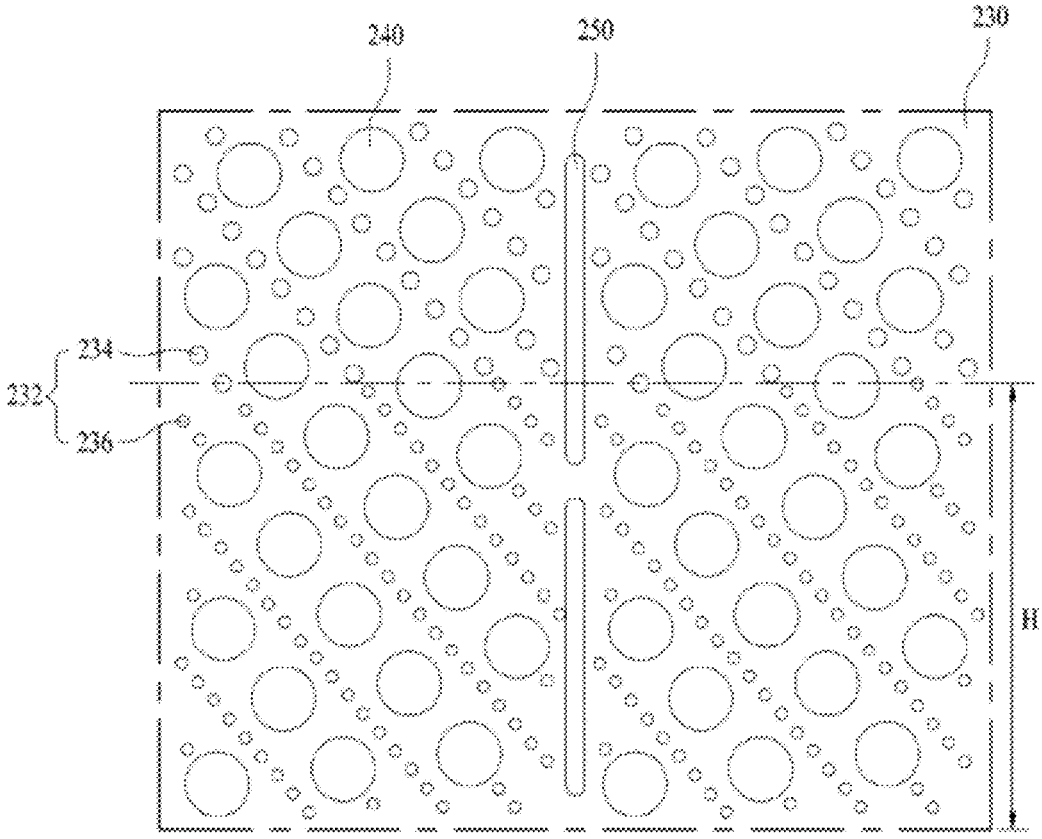
FIG. 3 is a partial plan view of a drum of a washing machine in accordance with another embodiment of the present invention.

FIG. 3 is a partial plan view of a drum of a washing machine in accordance with a further embodiment of the present invention.

With reference to FIG. 3, in the washing machine in accordance with this embodiment, a drum 230 may be rotated around a vertical axis. Therefore, a user may put laundry into the drum 230 downward while opening a door (not shown) provided on the upper portion of a cabinet.

Further, in the washing machine in accordance with this embodiment, the drum 230 may be provided with a plurality of through holes 232. Particularly, in the washing machine in accordance with this embodiment, the drum 230 may be provided such that perforation rates of the upper and lower portions of the drum 230 based on a designated height H as a boundary therebetween are different. Hereinafter, a 'perforation rate' used in the description is defined as the size of an object which may pass through the through holes 232 of the drum 230. For example, a large perforation rate may mean that the size of an object which may pass through one through hole is large, and a small perforation rate may mean that the size of an object which may pass through one through hole is small. Further, a large perforation rate may mean that the size of through holes is large, and a small perforation rate may mean that the size of through holes is small. Therefore, in this embodiment, different perforation rates of the upper and lower portions of the drum 230 based on the designated height H means that the sizes of the through holes 232 of the upper and lower portions of the drum 230 based on the designated height H are different.

In more detail, the perforation rate of the upper portion of the drum 230 may be larger than the perforation rate of the lower portion of the drum 230, and for example, the size of through holes 234 of the upper portion of the drum 230 may be greater than the size of through holes 236 of the lower portion of the drum 230. Therefore, the sizes of the through holes of the drum 230 may be changed at the designated height (hereinafter, referred to as a 'reference height') H. For example, the size of the through holes 234 of the upper portion of the drum 230 may be greater than the through holes 236 of the lower portion of the drum 230 based on the reference height H of the drum 230. In this case, the sizes of the through holes may be set, as follows. The through holes 234 of the upper portion of the drum 230 based on the reference height H may have a relatively large size so as to easily discharge foreign substances, such as lint, to the outside of the drum 230. However, since the excessively large size of the through holes of the drum 230 may weaken the drum 230, it is important to properly set the size of the through holes of the drum 230. For example, in the washing machine in accordance with this embodiment, the through holes 234 of the upper portion of the drum 230 may have a diameter of 3.5 to 4.0 mm, and preferably of 3.7 mm. Further, the through holes 236 of the lower portion of the drum 230 may have a smaller size than that of the through holes 234 of the upper portion of the drum 230.

Figure 4:
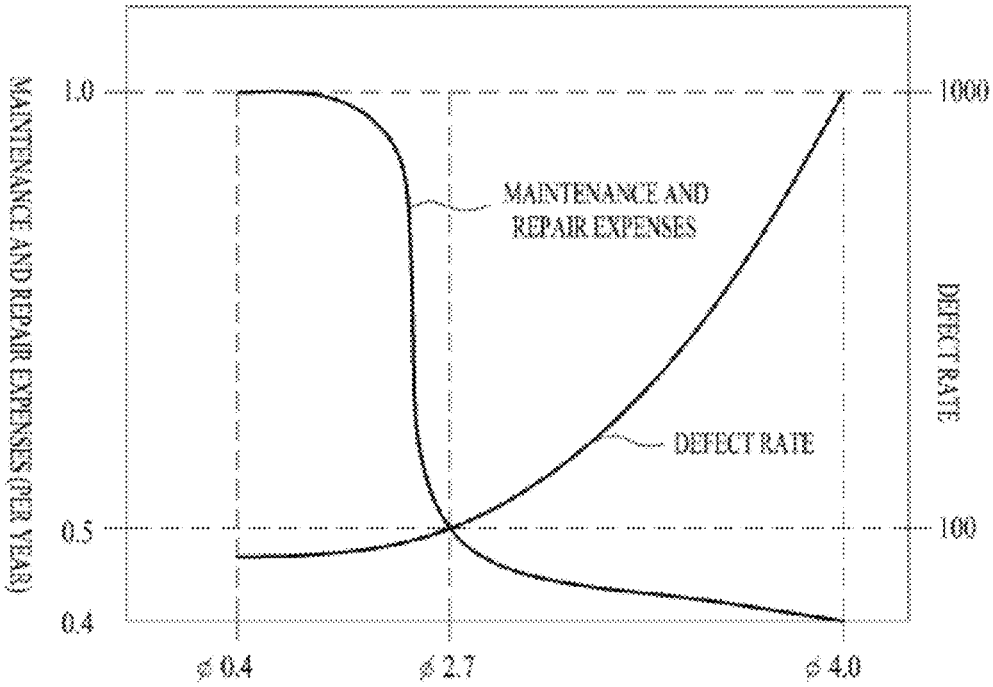
FIG. 4 is a graph illustrating maintenance and repair expenses and defect rates according to sizes of through holes of the drum.

FIG. 4 is a graph illustrating maintenance and repair expenses and defect rates according to sizes of through holes of the drum. In the graph of FIG. 4, a horizontal axis represents sizes of the through holes, a right vertical axis represents defect rates, and a left vertical axis represents maintenance and repair expenses. The defect rates are defined as defects generated by foreign substances (particularly, a memory wire from among laundry) caught in the through holes during driving of the washing machine, and the maintenance and repair expenses are defined as maintenance and repair expenses per year according to sizes of the through holes.

With reference to FIG. 4, it is understood that, as the size of the through holes decreases, foreign substances, such as a memory wire, are scarcely caught in the through holes and thus the defect rate is lowered. However, it is understood that, as the size of the through holes decreases, the maintenance and repair expenses per year according to use of the washing machine are raised. On the other hand, it is understood that, as the size of the through holes increases, foreign substances, such as a memory wire, are easily caught in the through holes and thus the defect rate is raised, but the maintenance and repair expenses per year according to use of the washing machine are lowered. Therefore, the value of the diameter of the through holes properly satisfying both the defect rate and the maintenance and repair expenses per year are in the range of about 2.5 to 3.0 mm. Therefore, the through holes 236 of the lower portion of the drum 230 in accordance with this embodiment may have a diameter of about 2.5 to 3.0 mm, as described above, and preferably of about 2.7 mm.

The reference height H used as the boundary at which the perforation rate of the drum 230 is changed may be properly set. For example, washing machine manufacturers may possess information regarding an amount of laundry which is most frequently used in the rinsing cycle. For example, the washing machine manufacturers may possess information that the amount of laundry which is most frequently used per rinsing cycle is 5 kg. In this case, the reference height H may be set to a water level corresponding to the most frequently used amount of laundry.

In this case, when the rinsing cycle is executed, foreign substances separated from laundry according to rotation of the drum 230 or the pulsator may be discharged to the outside of the drum 230 through the through holes 232 of the drum 230. Particularly, since the through holes 234 of the drum 230 located at positions above the reference height H (i.e., the water level in case that the amount of laundry is 5 kg) of the drum 230 have a relatively large size, when water flows due to rotation of the drum 230, the foreign substances located above the water level may be easily discharged to the outside of the drum 230 through the through holes 234 of the upper portion of the drum 230. Further, the foreign substances within the drum 230 float on water due to rotation of the drum 230 or the pulsator, thus being more easily discharged to the outside of the drum 230 through the through holes 234 of the upper portion of the drum 230. On the other hand, since the through holes 236 of the drum 230 located at positions lower than the reference height H of the drum 230 have a relatively small size, water smoothly passes through the through holes 236 but the foreign substances do not easily pass through the through holes 236. The small size of the through holes 236 of the lower portion of the drum 230 may prevent the foreign substances from being caught in the through holes 236 during passing through the through holes 236.

Further, instead of the through holes having two different sizes based on the reference height H of the drum 230, the size of the through holes may be gradually changed in a designated height section including the reference height H. The reason is that an amount of laundry desired to be washed by a user is not regular at all times. That is, in the case that the amount of laundry desired to be washed by the user is changed, if the through holes of the drum 230 have two different sizes based on the reference height H, a water level is located below the reference height H of the drum 230 and thus foreign substances in the drum 230 are not easily discharged to the outside when the amount of laundry does not reach the reference height H. The reason is that the size of the through holes of the lower portion of the drum 230 is smaller than that of the through holes of the upper portion of the drum 230. Therefore, if the drum 230 is configured such that the size of the through holes is gradually changed in the height section including the reference height H, foreign substances in the drum 230 may be easily discharged although the amount of laundry desired to be washed by the user is changed.

Figure 5:
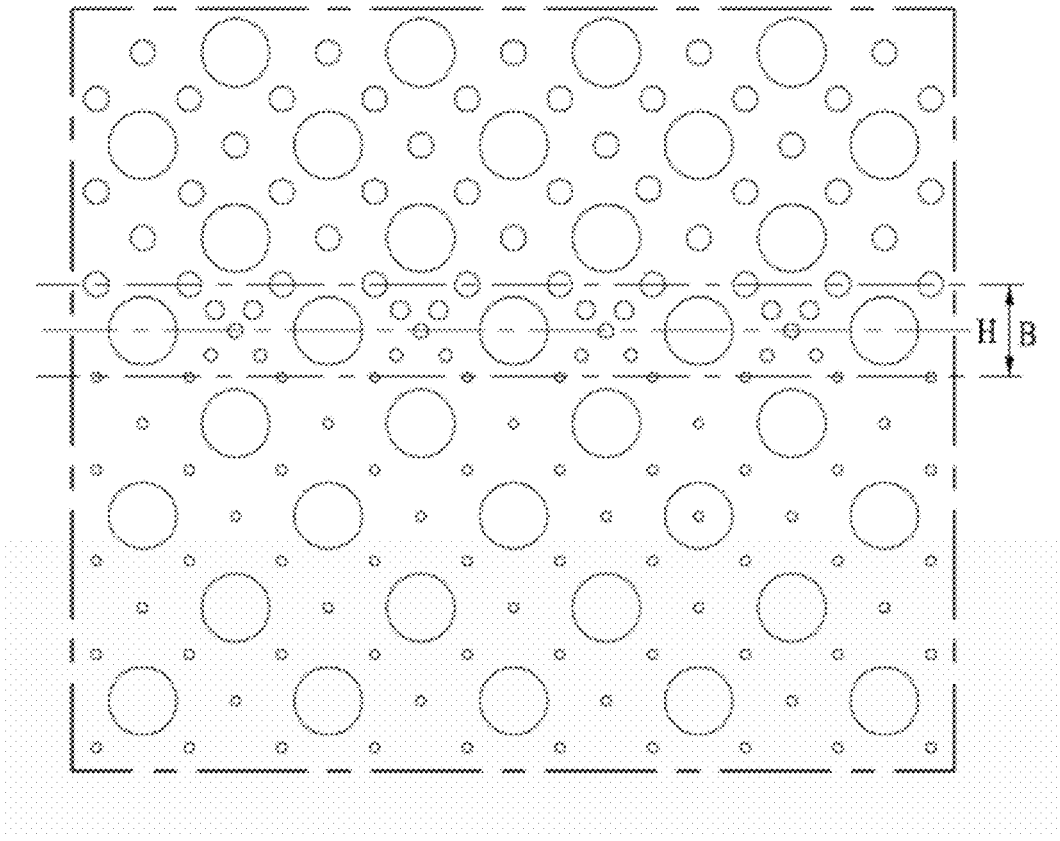
FIG. 5 is a partial plan view of a drum in accordance with another embodiment of the present invention.

FIG. 5 illustrates a drum in accordance with another embodiment of the present invention, in which the size of through holes is gradually changed.

With reference to FIG. 5, the size of the through holes is gradually changed in a designated height section B including the reference height H. For example, the size of the through holes may be gradually changed in a designated range above and below the reference height H, for example, by about 2 to 5 cm. In this case, the size of the through holes may be gradually decreased in a section below the reference height H by about 2 to 5 cm, and the size of the through holes may be gradually increased to a predetermined value in a section above the reference height H by about 2 to 5 cm.

Further, with reference to FIG. 3, the through holes 232 of the drum 230 may be arranged to be inclined at a designated angle. This serves to more easily discharge foreign substances floating on water to the outside of the drum 230 if the water in the drum 230 moves according to rotation of the drum 230 or the pulsator. That is, when the drum 230 or the pulsator is rotated, the water in the drum 230 moves and the water in the upper portion of the drum 230 moves in the rotating direction of the drum 230 or the pulsator. That is, if the through holes 232 are arranged to be inclined to the left of FIG. 3 at the designated angle, when the drum 230 is rotated in the counterclockwise direction (FIG. 3 is a plan view of the drum, seen from the inside of the drum), the water in the upper portion of the drum 230 moves along the inclined drum 230 and thus foreign substances are more easily discharged to the outside through the through holes 232.

Figure 6:
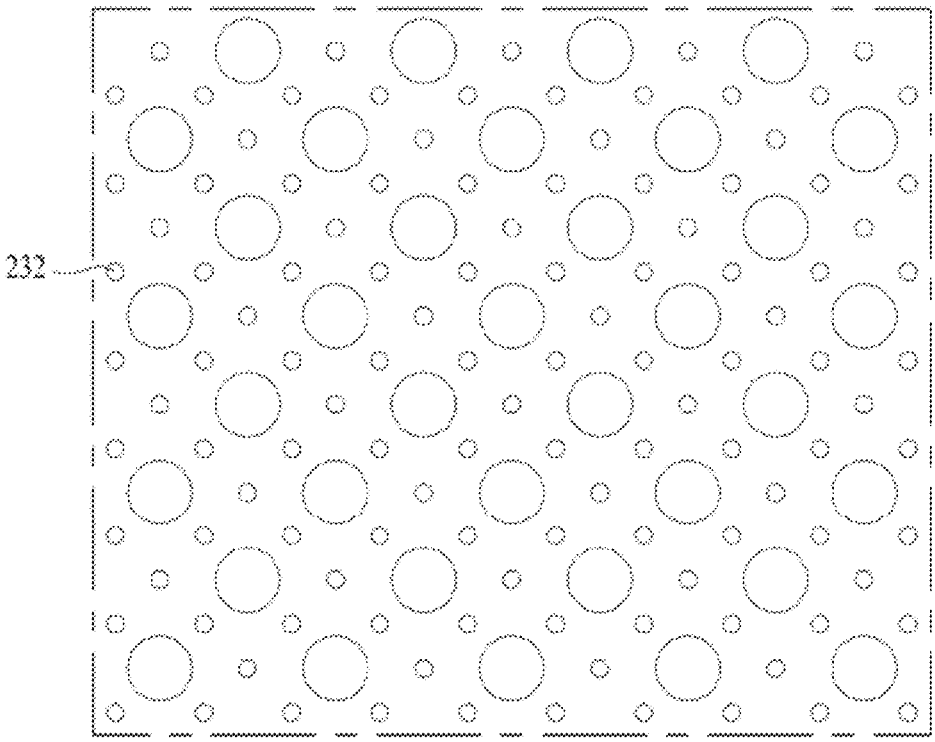
FIG. 6 is a partial plan view of a drum in accordance with a further embodiment of the present invention.

However, during the washing and rinsing cycles, the drum 230 may be rotated selectively in both directions as opposed to being rotated in only one direction. Therefore, if the through holes 232 are arranged to be inclined in only one direction, as described above, foreign substances may not be effectively discharged to the outside through the through holes 232 during rotation of the drum 230 in both directions. FIG. 6 is a partial plan view of a drum in accordance with a further embodiment of the present invention. With reference to FIG. 6, the drum 230 in accordance with this embodiment may be provided with plural through holes 232 which are arranged to be inclined at a designated angle in both directions as opposed to in one direction. Therefore, even if the drum 230 is rotated in both directions and the moving direction of water in the drum 230 is changed, foreign substances may be easily discharged to the outside through the through holes 232.

With reference again to FIG. 3, the number of the upper through holes 234 located above the reference height H of the drum 230 may be smaller than the number of the lower through holes 236 located below the reference height H of the drum 230. The reason is that the reference height H defining the boundary between the upper and lower portions of the drum 230 is closer to the upper portion of the drum 230. Further, since the size of the upper through holes 234 is larger than the size of the lower through holes 236, if the number of the upper through holes 234 is greater than the number of the lower through holes 236, the strength of the drum 230 may be weakened.

The drum 230 may be provided with a plurality of embossed protrusions 240 protruding toward the inside of the drum 230 and formed between the through holes 232 of the drum 230. These protrusions 240 protrude to a designated height toward the inside of the drum 230, and improve washing performance and rinsing performance through friction with laundry when the drum 230 is rotated. Because, if the drum 230 has a smooth inner surface without any protrusion and depression, washing performance and rinsing performance cannot be raised to a designated value or more due to excessively low friction between laundry and the drum 230 although the drum 230 is rotated.

The drum 230 in accordance with this embodiment may be provided with ribs 250 extending to a designated length in the vertical direction. The ribs 250 may protrude toward the inside of the drum 230. The ribs 250 serve to increase the strength of the drum 230 and to increase friction with laundry together with the protrusions 240 to improve washing performance and rinsing performance, simultaneously.

Hereinafter, a control method of a washing machine in accordance with one embodiment of the present invention will be described in detail.

Generally, in a pulsator type washing machine, laundry is treated through a washing cycle, a rinsing cycle and a spin-drying cycle.

The washing cycle includes a water supply step of supplying wash water, a detergent dissolving step of dissolving detergent and a washing step of removing foreign substances from laundry, the rinsing cycle includes a drainage step of draining wash water, a spin-drying step of removing wash water from the laundry and a rinsing step of re-supplying wash water to rinse the laundry, and the spin-drying cycle includes a drainage step of draining wash water and a spin-drying step.

During the washing cycle, the rinsing cycle and the spin-drying cycle, in the detergent dissolving step, the washing step and the rinsing step, the detergent is dissolved in wash water, foreign substances are removed from the laundry, and the laundry is rinsed through a pulsator rotating operation. However, when the pulsator rotating operation is continuously executed, the laundry is worn out due to friction between the laundry and friction between the laundry and the pulsator, thus easily generating lint.

Therefore, in order to reduce abrasion of the laundry and to effectively discharge the generated lint while maintaining the washing performance of the laundry, the control method in accordance with this embodiment is proposed.

The washing machine in accordance with this embodiment treats laundry through the washing cycle, the rinsing cycle and the spin-drying cycle, as described above. In the washing cycle, the laundry is washed through the water supply step, the detergent dissolving step and the washing step. In the rinsing cycle, the laundry is rinsed through the drainage step, the spin-drying step and the rinsing step, and in the spin-drying cycle, the laundry is treated through the drainage step and the spin-drying step.

In the washing cycle, one selected from among a drum rotating operation (for convenience, referred to as a "tub/drum rotating operation"), a centrifugal tumbling operation, a pulsator rotating operation, and combinations thereof is executed for a washing time set according to an amount of laundry or a washing time selected by a user (this will be described later).

Further, in the rinsing cycle, during the rinsing step which is not final, water supply, tub/drum rotation and partial drainage are repeated at least three times, and the rinsing step may be executed plural times according to the amount of the laundry and a contamination degree of the laundry. The rinsing step may be executed by properly combining the tub/drum rotating operation, water supply and drainage (this will be described later).

In the spin-drying cycle, wash water is separated from the laundry through high-velocity rotation of the drum 30.

In the present invention, the washing machine is driven at a water level lower than a reference water level during an operation having weak mechanical force (for example, the centrifugal tumbling operation), and is driven at the reference water level during an operation having middle mechanical force (for example, the tub/drum rotating operation or combination of the centrifugal tumbling operation and the tub/drum rotating operation). Further, the washing machine is driven at a water level higher than the reference water level during an operation having strong mechanical force (for example, the pulsator rotating operation).

With reference to FIGS. 7 to 11, such a control method of the washing machine will be described in detail, as follows.

Figure 7:
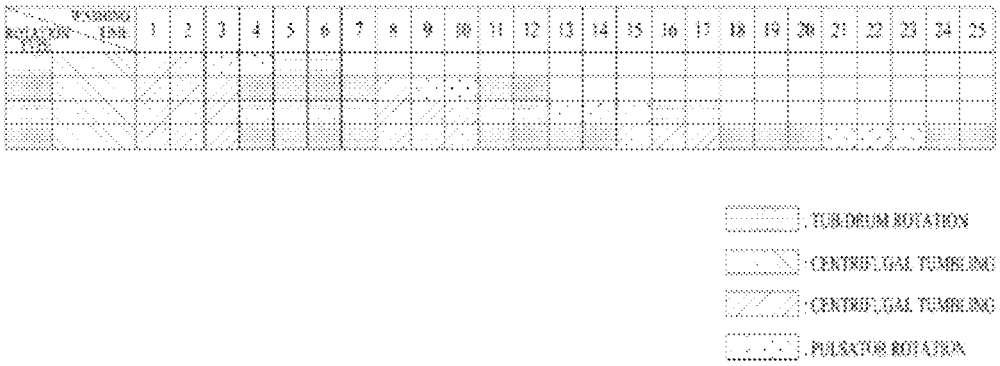
FIG. 7 is a graph illustrating a washing program of the washing machine of FIG. 1.

As shown in FIG. 7, in the water supply step, wash water is supplied to uniformly soak laundry while rotating the drum 30 at a low RPM in one direction. For example, the drum 30 may be controlled to be rotated at 20 RPM. When wash water reaches a certain level, wash water is supplied while rotation of the drum 30 is stopped (section D of FIG. 11).

When supply of wash water has been completed, the centrifugal tumbling operation is executed to dissolve detergent in wash water to uniformly mix the detergent and wash water with the laundry. The centrifugal tumbling operation uses a principle in that, when the drum 30 is rotated at a higher velocity than that of the drum 30 in the supply of wash water, wash water ascends upward along the inner wall of the tub 20 due to centrifugal force and then drops down to the inside of the drum 30 along the cover of the tub 20 (with reference to FIG. 9). The centrifugal tumbling operation may be executed, for example, when the drum 30 is rotated at 170 to 180 RPM. When the centrifugal tumbling operation is executed, the detergent may be easily dissolved in wash water and easily mixed with the laundry due to rotation and falling of wash water.

In the detergent dissolving step in which the centrifugal tumbling operation is executed, wash water preferably maintains a water level B lower than a reference water level A. The reason is that high-concentration wash water, obtained by dissolving the detergent in a smaller amount of wash water than the amount of wash water at the reference water level A, soaks the laundry and thus contaminants may be more rapidly separated from the laundry in the washing step which will be executed later (section E of FIG. 11).

The conventional pulsator type washing machine rotates the pulsator in the water supply step and the detergent dissolving step, thus increasing abrasion of laundry to be washed and generating a large amount of lint. However, the washing machine in accordance with the embodiment of the present invention reduces abrasion of laundry to be washed through the rotation of the drum 30 and the centrifugal tumbling operation.

When the dissolution of the detergent has been completed, the washing step of washing of the laundry is executed. Here, the washing step is executed at the reference water level A and a water level C higher than the reference water level A (with reference to FIG. 11).

As shown in FIG. 7, in the washing step, the centrifugal tumbling operation (with reference to FIG. 9), the tub/drum rotating operation (with reference to FIG. 8) and the pulsator rotating operation are executed together. That is, the centrifugal tumbling operation and the tub/drum rotating operation are alternately executed for a designated time and then the pulsator rotating operation is executed. After the pulsator rotating operation, the tub/drum rotating operation may be additionally executed.

Figure 11:
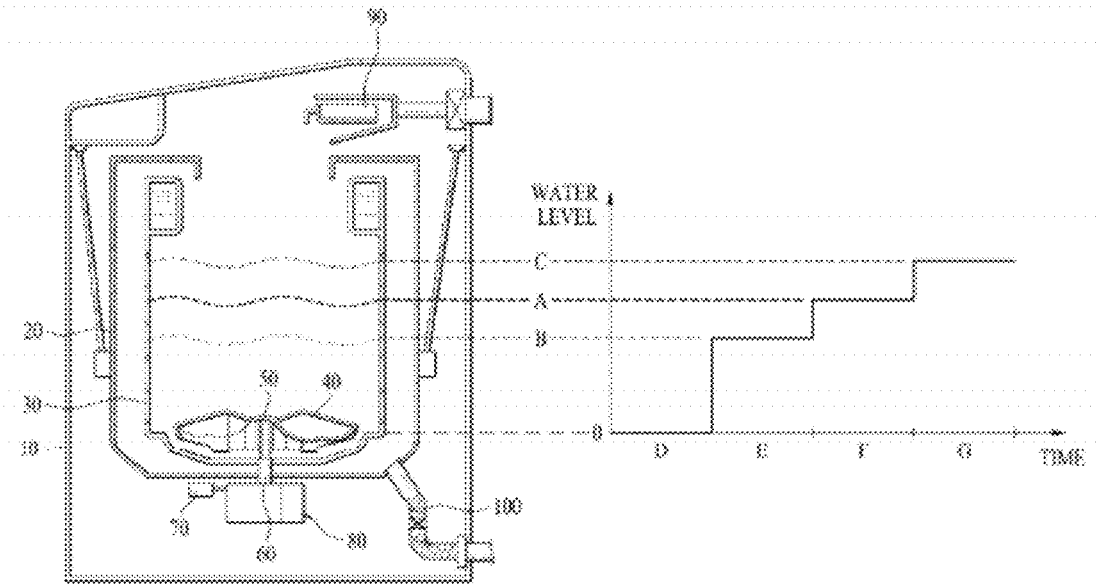
FIG. 11 is a view illustrating a water level state in a washing cycle of the washing machine of FIG. 1.

In the washing step, the water level set according to the amount of the laundry or the water level selected by the user serves as the reference water level A, the centrifugal tumbling operation and the tub/drum rotating operation are executed at the reference water level A (section E of FIG. 11), and the pulsator rotating operation is executed at the water level C higher than the reference water level A (section G of FIG. 11).

The reason why the water level is changed in the same washing step is to drive the drum 30 at the reference water level A during the centrifugal tumbling operation and the tub/drum rotating operation scarcely influencing abrasion of laundry and to drive the pulsator 40 at the water level C higher than the reference water level A during the pulsator rotating operation greatly influencing abrasion of the laundry so as to minimize the abrasion of the laundry. Further, in order to maintain washing performance, the pulsator rotating operation is executed together with the centrifugal tumbling operation and the tub/drum rotating operation.

For example, if in FIG. 7, the first graph is referred to as water level 2, the second graph is referred to as water level 4, the third graph is referred to as water level 6, and the fourth graph is referred to as water level 10 (the height of wash water is classified into 10 grades), the tub/drum rotating operation in the water supply step may be executed for about 30 seconds and the centrifugal tumbling operation in the detergent dissolving step may be executed for about 2 minutes. Here, the tub/drum rotating operation may be executed at a velocity of 64 to 100 RPM according to an amount of wash water or an amount of laundry to be washed.

In the washing step, for example, in the case of water level 4, the centrifugal tumbling operation may be executed for 3 minutes, the tub/drum rotating operation may be executed for 4 minutes, the centrifugal tumbling operation may be executed for 1 minute, and then the pulsator rotating operation may be executed for 2 minutes. After the pulsator rotating operation, the tub/drum rotating operation may be additionally executed for 2 minutes so as to uniformly disperse the laundry to achieve effective rinsing of the laundry in the rinsing cycle. In this case, the washing step at water level 4 may be set to a total of 12 minutes.

Based on the water level of wash water, the detergent dissolving step may be executed at water level 3 lower than water level 4 serving as the reference water level, the centrifugal tumbling operation and the tub/drum rotating operation may be executed at water level 4 serving as the reference water level, and the pulsator rotating operation may be executed at water level 6 higher than the reference water level.

For example, in the case of water level 6, the water supply step and the detergent dissolving step may be executed in the same manner as water level 4, but time taken to execute the centrifugal tumbling operation, the tub/drum rotating operation and the pulsator rotating operation may be increased. Based on the water level of wash water, the detergent dissolving step may be executed at water level 3 lower than water level 6 serving as the reference water level, the centrifugal tumbling operation and the tub/drum rotating operation may be executed at water level 6 serving as the reference water level, and the pulsator rotating operation may be executed at water level 8 higher than the reference water level.

That is, the detergent is dissolved in wash water at a water level lower than the reference water level to achieve high-concentration washing, and washing having weak mechanical force through the centrifugal tumbling operation and the tub/drum rotating operation is executed at the reference water level to maintain washing performance. Further, washing having strong mechanical force through the pulsator rotating operation is executed at a water level higher than the reference water level to minimize abrasion of laundry and to maintain washing performance.

However, if washing is carried out at a water level lower than water level 4, the minimum amount of wash water in which the detergent is dissolved should be assured, and thus the detergent dissolving step is preferably executed at the corresponding water level.

Further, in the case of a water level higher than water level 9, the detergent is also dissolved in wash water at the corresponding water level, and the pulsator rotating operation is preferably executed at the corresponding water level because the corresponding water level corresponds to the maximum water level to minimize abrasion of the laundry.

While the main object of the control method of the washing machine in the washing cycle is to minimize abrasion of the laundry, the main object of the control method of the washing machine in the rinsing cycle is to minimize discharge of lint generated by friction and abrasion of the laundry. Hereinafter, the control method of the washing machine in the rinsing cycle will be described.

In the rinsing cycle, wash water used in washing is drained and spin-dried (the drainage step and the spin-drying step), and the water level of wash water and the rinsing operation are controlled to maximize discharge foreign substances, such as lint.

Figure 8:
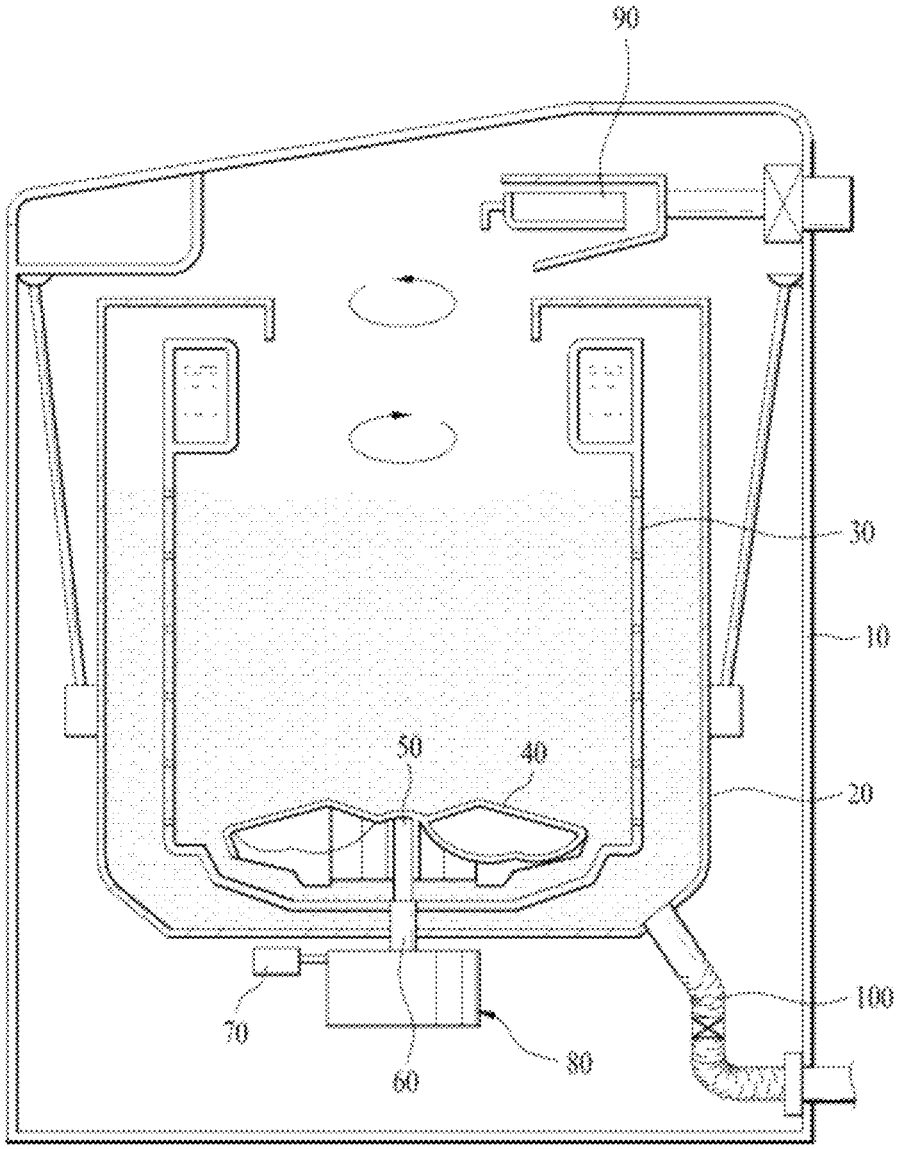
FIG. 8 is a cross-sectional view illustrating a tub/drum rotating state of the washing machine of FIG. 7.
Figure 9:
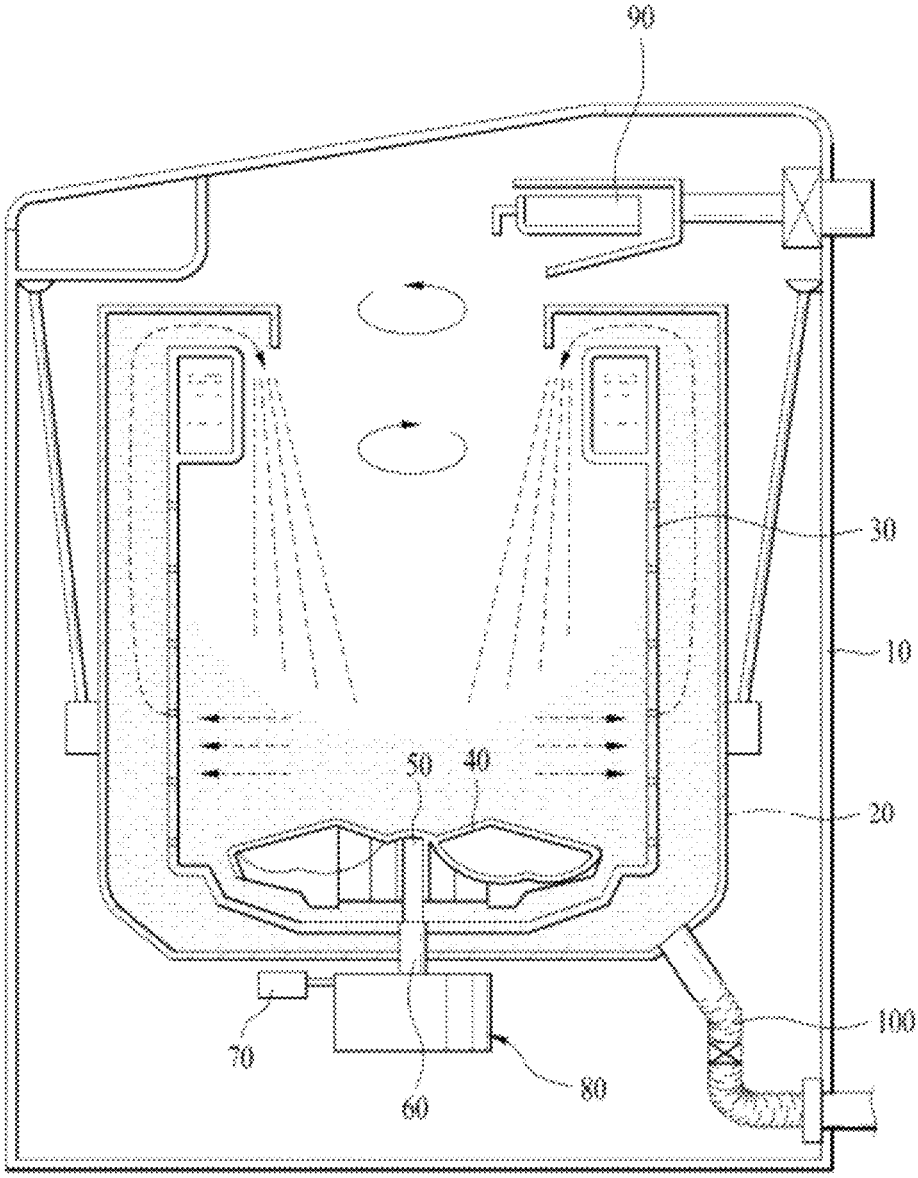
FIG. 9 is a cross-sectional view illustrating a centrifugal tumbling state of the washing machine of FIG. 7.
Figure 10:
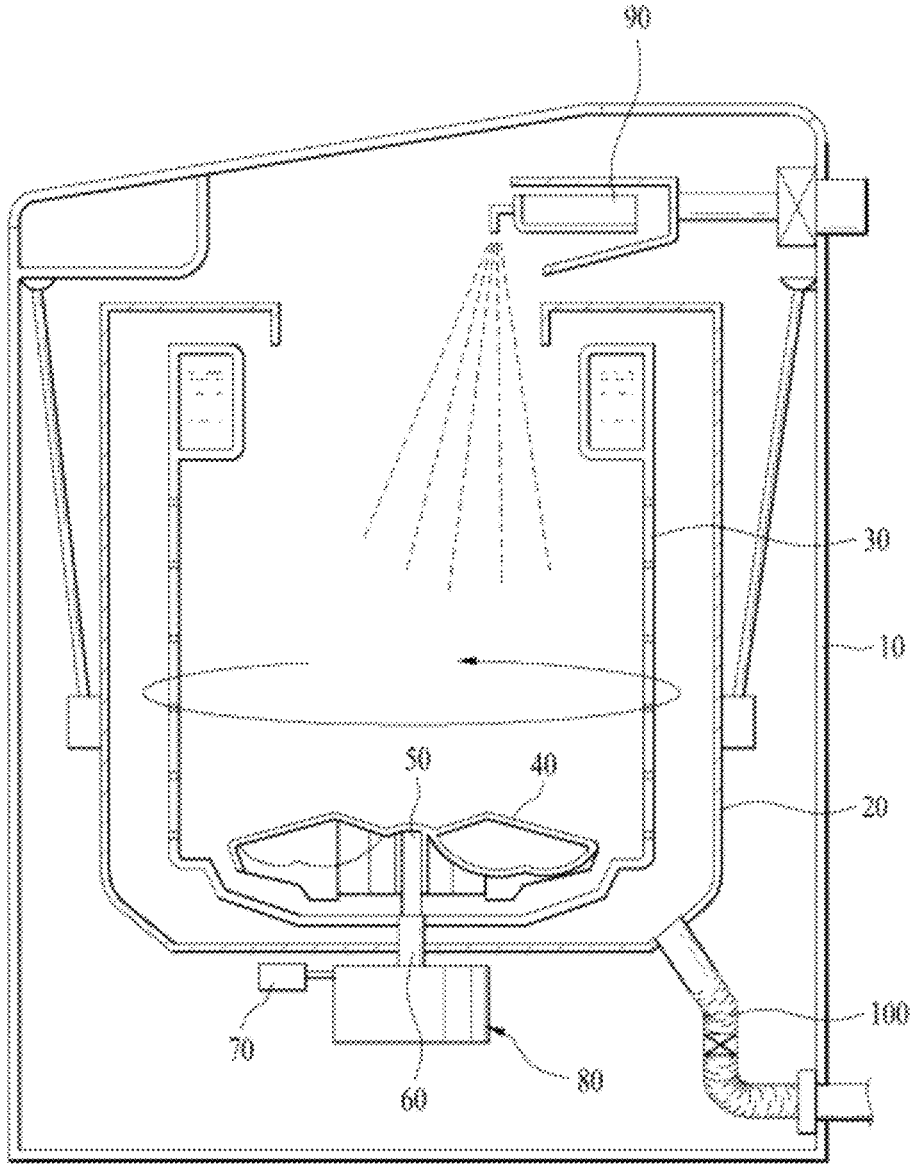
FIG. 10 is a cross-sectional view illustrating a water supply and rinsing state of the washing machine of FIG. 7.
Figure 12:
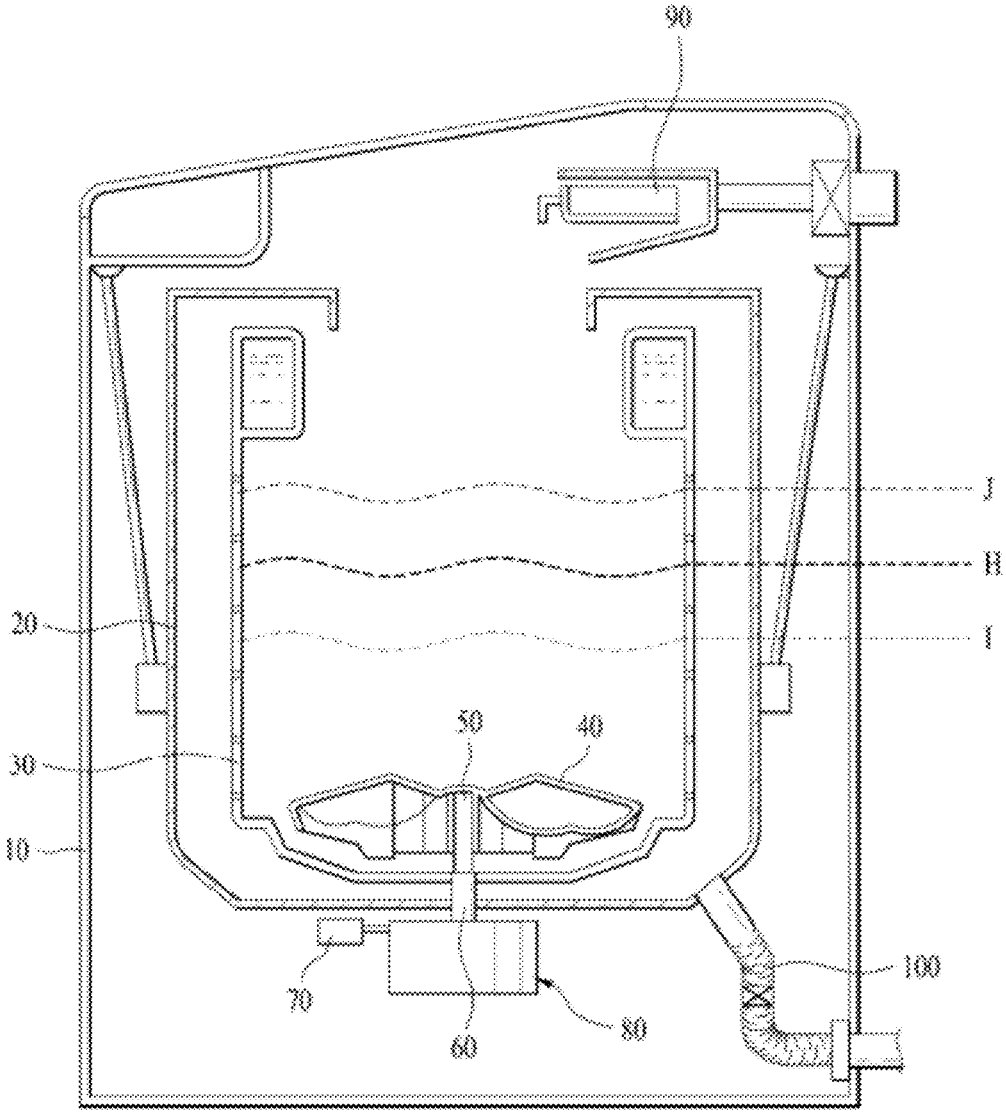
FIG. 12 is a view illustrating a water level state in a rinsing cycle of the washing machine of FIG. 1.

As shown in FIG. 12, after the drainage step and the spin-drying step have been completed, wash water is supplied to a water level J higher than the reference water level H, and then the tub/drum rotating operation is executed for a designated time (with reference to FIG. 8). The tub/drum rotating operation serves to release entanglement of the laundry to separate foreign substances, such as lint stuck to the laundry or floating on wash water, from the laundry. Thereafter, wash water is partially drained down to the reference water level H to discharge the foreign substances, such as lint, wash water is partially re-supplied up to the water level J higher than the reference water level H, and then the tub/drum rotating operation is executed. Here, drainage is preferably executed under the condition that the drum 30 is stopped so as to easily discharge the foreign substances, such as lint. Such a rinsing process including the supply of wash water, the tub/drum rotating operation and the partial drainage is executed in only a rinsing step which is not final, and the rinsing process may be repeated at least three times.

When wash water is completely drained and then resupplied, it is difficult to complete handling of laundry within a set washing time. Therefore, through the partial drainage, the degree of freedom of floating substances, such as lint, is increased and the discharge effect of the foreign substances is raised.

The final rinsing step after such a rinsing step is a general rinsing step in which rinsing of the laundry is executed at the reference water level H (with reference to FIG. 10), and thereafter, the spin-drying cycle (the drainage step and the spin-drying step) is executed, thereby completing handling of the laundry.

For example, on the assumption that the rinsing step is executed twice in the rinsing cycle, the rinsing process may be repeated three times in the first rinsing step. That is, after the drainage step, the spin-drying step, the supply of wash water and the tub/drum rotating operation are executed for about 20 seconds, the partial drainage, the additional supply of wash water and the tub/drum rotating operation are executed for about 20 seconds, and the partial drainage, the additional supply of wash water and the tub/drum rotating operation are executed for about 20 seconds, the second rinsing step is started via the drainage step. The second drainage step is controlled such that after the spin-drying step is executed without rise of the reference water level H and then wash water is supplied to the reference water level H, the tub/drum rotating operation is executed for about 20 seconds and then wash water is completely drained.

Figure 13:
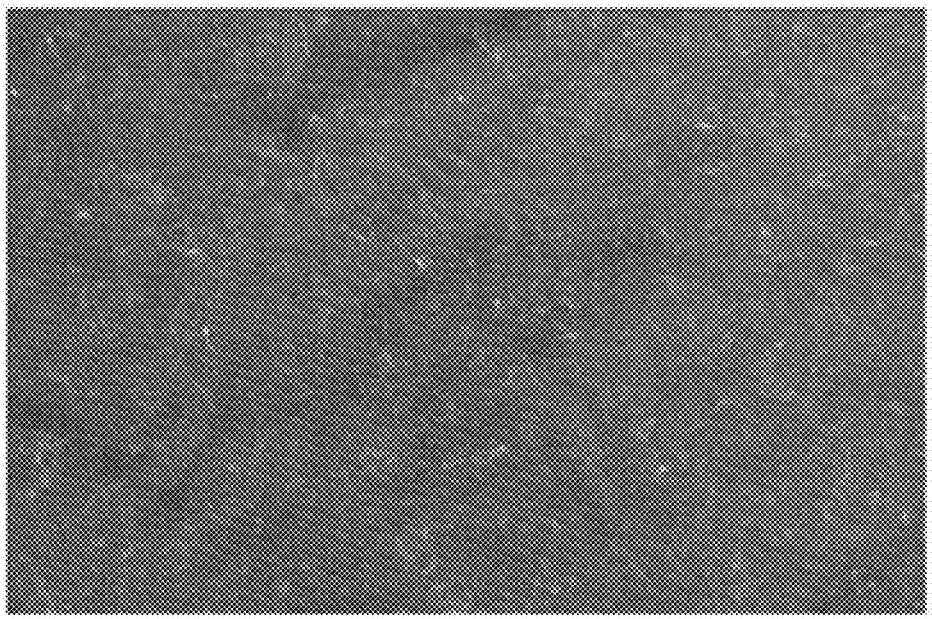
FIG. 13 is a photograph illustrating a contamination degree during washing using a conventional washing machine.
Figure 14:
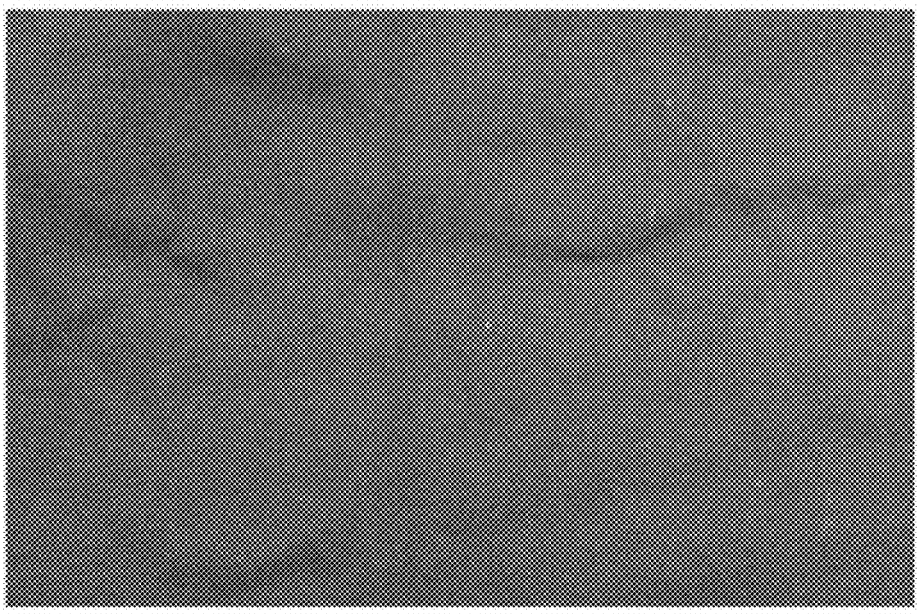
FIG. 14 is a photograph illustrating a contamination degree during washing using a washing machine in accordance with one embodiment of the present invention.

As shown in FIGS. 13 and 14, the control method of the washing machine in accordance with the embodiment of the present invention reduces abrasion of laundry to minimize generation of foreign substances, such as lint, while maintaining washing performance by raising the water level of wash water during the pulsator rotating operation.

Further, the control method of the washing machine executes the centrifugal tumbling operation and the tub/drum rotating operation scarcely influencing abrasion of the laundry at the reference water level to maintain washing performance, and improves discharge of the foreign substances, such as lint, through additional supply of wash water and partial drainage.

Although the above-described embodiment exemplarily illustrates the washing machine executing both the pulsator rotating operation and the tub/drum rotating operation, the present invention may be applied to a pulsator rotating type washing machine and a drum rotating type washing machine as long as a drain valve is not operated during rotation of a spin-drying shaft except for the case requiring drainage.

Figure 15:
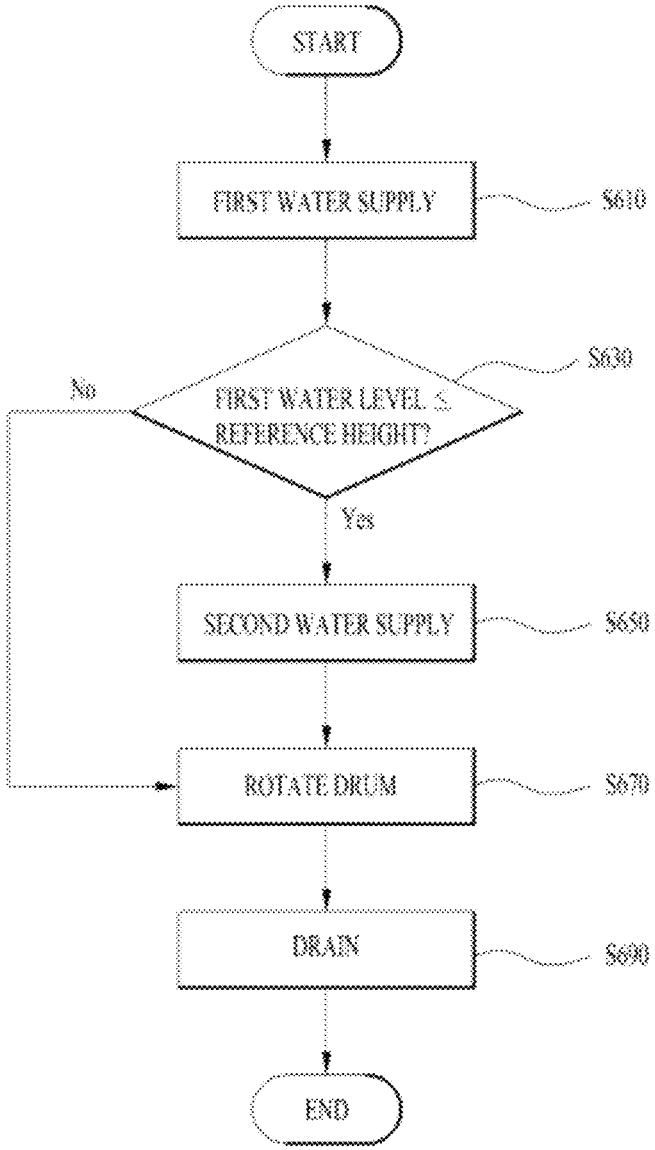
FIG. 15 is a flowchart illustrating a control method of a washing machine in accordance with another embodiment of the present invention.
Figure 16:
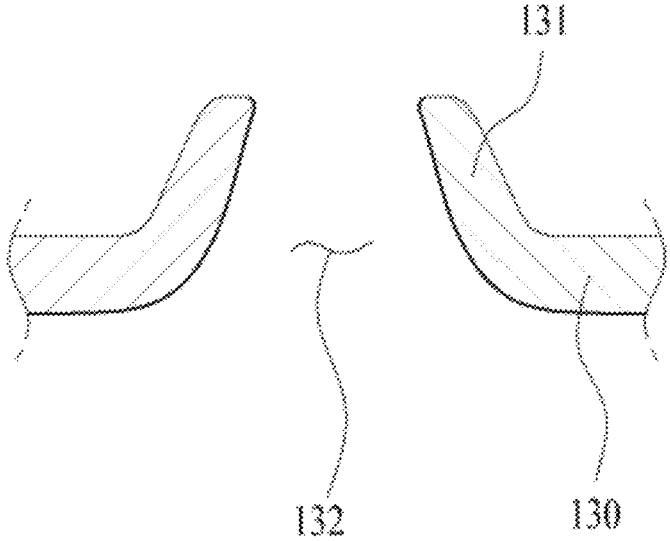
FIG. 16 is a partial cross-sectional view illustrating a drum in accordance with yet another embodiment of the present invention.

FIG. 15 is a flowchart illustrating a control method of a washing machine in accordance with another embodiment of the present invention, particularly in a rinsing cycle.

With reference to FIG. 15, the control method includes a first water supply step S610 of supplying wash water to the inside of a drum. In the first water supply step S610, wash water is supplied up to a first water level under the control of a controller. Here, the first water level may correspond to an amount of laundry in the drum. That is, the controller of the washing machine may measure the amount of the laundry within the drum and set a water level corresponding to the measured amount of the laundry as the first water level, prior to the rinsing cycle. The laundry amount measuring step may be executed in the washing cycle prior to the rinsing cycle, if the washing machine is driven according to a course selected by a user. Further, if the user does not select a course but the rinsing cycle is separately executed, a laundry amount sensing step may be executed prior to the first water supply step. A method of sensing the amount of the laundry is well known in the art, and a detailed description thereof will thus be omitted.

After wash water is supplied up to the first water level corresponding to the amount of the laundry, the controller compares the first water level with a reference height at which the perforation rate of the drum is changed (S630). This serves to easily discharge foreign substances, such as lint, in a drum rotating step (S670) which will be described later. That is, foreign substances floating on water due to driving of the drum may be discharged to the outside of the drum through upper through holes 134 only if the water level in the drum is raised above the reference height H or more. Therefore, when the first water level corresponding to the amount of the laundry is less than the reference height H, the controller executes a second water supply step (S650) in which wash water is supplied up to a second water level. In this case, the second water level may be set to be greater than the reference height H at which the perforation rate is changed. When the second water level is set to be excessively high, water may be wasted if the amount of the laundry is small. Therefore, the second water level may be set to be a proper height between the reference height H and the upper end of the drum. For example, the second water level may be set to be a middle height between the reference height H and the upper end of the drum.

Thereafter, the controller rotates the drum at a designated velocity (S670). When the drum is rotated after wash water is supplied to the second water level higher than the reference height H, the foreign substances separated from the laundry float on water. Further, when the drum is continuously rotated, the foreign substances floating on water may be discharged to the outside of the drum through the upper through holes 134 of the drum due to water movement. Therefore, the foreign substances in the drum may be discharged to the outside of the drum.

Preferably, re-inflow of the foreign substances, discharged to the outside of the drum, into the drum is prevented. For this purpose, if the through holes are formed on the drum, a punching operation is implemented in the outward direction from the inside of the drum. Such a punching operation may generate bending parts 131 bent outward from the inside of the drum 130. Therefore, discharge of the foreign substances from the inside of the drum toward the outside of the drum is easy, but inflow of the foreign substances from the outside of the drum toward the inside of the drum is difficult.

When the first water level is greater than the reference height as a result of the above-described comparison step (S630), the drum rotating step (S670) is directly executed without the second water supply step (S650). The reason is that the first water level corresponding to the amount of the laundry is already higher than the reference height H at which the perforation rate of the drum is changed and thus additional supply of wash water is not necessary.

After the drum rotating step is executed for a designated time, the controller drains water contained within the drum and the tub (S690). By draining the water within the drum and the tub, foreign substances, such as lint, located between the drum and the tub may be discharged. Preferably, in the drainage step, the drum is not rotated in order to prevent the foreign substances from flowing back into the drum.

In the above-described first water supply step (S610) and second water supply step (S650), the controller may further rotate the drum in at least some sections. Of course, the drum may be rotated throughout the entirety of the first water supply step (S610) and the second water supply step (S650). By rotating the drum simultaneously with supply of water, foreign substances stuck to laundry within the drum may be more easily separated from the laundry. Therefore, in the drum rotating step (S670), a large amount of foreign substances may be discharged to the outside of the drum.

The rinsing cycle is not executed only once, but may be repeated a designated number of times. For example, the above-described second water supply step (S650), drum rotating step (S670) and drainage step (S690) may be combined into one cycle and thus be repeated. That is, after the drainage step (S690), the second water supply step (S650) and the drum rotating step (S670) and the drainage step (S690) may be repeated. Preferably, in the drainage step, the water in the drum is not completely drained but is partially drained such that the water remains at a designated water level. When the water in the drum is completely drained, water needs to be supplied up to the second water level in the second water supply step (S650) and water consumption considerably increases. Therefore, in order to reduce water consumption, if the above cycle is repeated, the water in the drum is not completely drained in the drainage step (S690) but is partially drained such that the water remains at the designated water level, for example, the first water level.

As apparent from the above description, a control method of a washing machine in accordance with one embodiment of the present invention minimizes damage to laundry to be washed and generation of lint from the laundry and maximizes discharge of the generated lint while maintaining washing performance, thereby effectively washing the laundry.

It will be apparent to those skilled in the art that various modifications and change can be made in the present invention without departing from the spirit or scope of the invention. Thus, it is intended that the present invention covers the modifications and change of this invention provided they come within the scope of the appended claims and their equivalents.

What is claimed is:

1. A control method of a washing machine comprising:

executing a washing cycle to wash laundry to be washed by supplying wash water, dissolving detergent in wash water and washing the laundry;

executing a rinsing cycle to rinse the laundry by draining wash water, spin-drying the laundry, and rinsing the laundry; and executing a spin-drying cycle to spin-dry the laundry by draining wash water and spin-drying the laundry, wherein the dissolving of the detergent is carried out at a water level lower than a predetermined reference water level, wherein, in the washing of the laundry, a centrifugal tumbling operation of rotating a drum at a high velocity in one direction to cause wash water to flow over the drum and then to drop onto the laundry, a tub/drum rotating operation of rotating the drum in both directions, and a pulsator rotating operation of rotating a pulsator in both directions are executed together, wherein the centrifugal tumbling operation and the tub/drum rotating operation are executed at the predetermined reference water level, and the pulsator rotating operation is executed at a water level higher than the reference water level, and wherein the centrifugal tumbling operation and the tub/drum rotating operation are alternately executed for a designated time and then the pulsator rotating operation is executed.

2. The control method according to claim 1, wherein, in the washing of the laundry, the centrifugal tumbling operation, the tub/drum rotating operation and the pulsator rotating operation are executed at least once for a predetermined washing time.

3. The control method according to claim 2, wherein, in the washing of the laundry, a tub/drum rotating operation to disperse the laundry is further executed after the pulsator rotating operation.

4. The control method according to claim 1, wherein the rinsing of the laundry is executed plural times automatically according to an amount of the laundry or by selection of a user, and, in the rinsing of the laundry prior to the final rinsing of the laundry, wash water is additionally supplied to a water level higher than the predetermined reference water level.

5. The control method according to claim 4, wherein, in the rinsing of the laundry prior to the final rinsing of the laundry, the drum is rotated after the additional supply of wash water.

6. The control method according to claim 5, wherein, in the rinsing of the laundry prior to the final rinsing of the laundry, wash water in the drum is partially drained after the rotation of the drum such that wash water is lowered to the reference water level from the water level higher than the reference water level.

7. The control method according to claim 6, wherein, in the rinsing of the laundry prior to the final rinsing of the laundry, the additional supply of wash water, the rotation of the drum and the partial drainage are repeated plural times.

8. The control method according to claim 7, wherein, in the rinsing of the laundry prior to the final rinsing of the laundry, a drain valve is closed during the rotation of the drum.

9. The control method according to claim 7, wherein the partial drainage is executed in a stopped state of the drum.

10. A control method of a washing machine comprising:

executing a washing cycle to wash laundry to be washed by supplying wash water, dissolving detergent in wash water and washing the laundry, wherein, in the washing of the laundry, a centrifugal tumbling operation of rotating a drum at a high velocity in one direction to cause wash water to flow over the drum and then to drop onto the laundry, a tub/drum rotating operation of rotating the drum in both directions, and a pulsator rotating operation of rotating a pulsator in both directions are executed together, wherein the centrifugal tumbling operation and the tub/drum rotating operation and are executed at the predetermined reference water level, and the pulsator rotating operation is executed at a water level higher than the reference water level, wherein the centrifugal tumbling operation and the tub/drum rotating operation are alternately executed for a designated time and then the pulsator rotating operation is executed.

11. The control method according to claim 10, wherein the dissolving of the detergent is carried out at a water level lower than a predetermined reference water level.

12. The control method according to claim 11, wherein detergent dissolving step is carried out by the centrifugal tumbling operation.

13. The control method according to claim 12, wherein, in the washing of the laundry, the tub/drum rotating operation is additionally executed after the pulsator rotating operation.

* * * * *